United States Patent [19]

Holz et al.

[11] 3,964,996

[45] June 22, 1976

[54] CLASSIFYING UNIT FOR FIBROUS SUSPENSIONS

[75] Inventors: Emil Holz, Eningen; Reinhold Kapernick, Reutlingen, both of Germany

[73] Assignee: Hermann Finckh Metalltuch- und Maschinenfabrik, Reutlingen, Germany

[22] Filed: Feb. 28, 1975

[21] Appl. No.: 554,150

[30] Foreign Application Priority Data

Mar. 20, 1974 Germany ..... 2413310

[52] U.S. Cl. ..... 209/17; 209/273; 209/306

[51] Int. Cl.[2] ..... B03B 7/00

[58] Field of Search ..... 209/17, 211, 250, 305, 209/306, 273; 210/84, 512, 298, 304

[56] References Cited

UNITED STATES PATENTS

| | | | |
|---|---|---|---|
| 3,255,883 | 6/1966 | Nelson et al. | 209/17 |
| 3,276,583 | 10/1966 | Carr | 209/211 |
| 3,363,759 | 1/1968 | Clarke-Pounder | 209/306 X |
| 3,458,038 | 7/1969 | Young | 209/306 X |
| 3,558,484 | 1/1971 | Carr | 209/211 X |
| 3,612,276 | 10/1971 | Lowe | 209/211 |
| 3,859,206 | 1/1975 | Baggaley | 209/17 |

FOREIGN PATENTS OR APPLICATIONS

| | | | |
|---|---|---|---|
| 1,461,090 | 10/1970 | Germany | 209/17 |

*Primary Examiner*—Frank W. Lutter
*Assistant Examiner*—Ralph J. Hill
*Attorney, Agent, or Firm*—Shenier & O'Connor

[57] ABSTRACT

A classifying apparatus is disclosed for use in separation of different portions of fibrious suspensions such as waste papers stock coming from a pulper. The apparatus is a unit comprising a vortex cleaner combined with a pressure screen. It includes a cylindric rotor whose circumferential portion carries agitating rods for the screen, the bottom of the rotor being provided with means for intensifying the motion of the stock fed into the vortex cleaner portion of the apparatus. The cylindric rotor defines a comparatively narrow gap between the rotor and the screen cage.

15 Claims, 6 Drawing Figures

CLASSIFYING UNIT FOR FIBROUS SUSPENSIONS

The present invention relates to a classifying unit for fibrous suspension, comprising a pressure screen arranged in combination with a vortex cleaner, wherein there is provided in the upper portion of a chamber a vertically disposed stationary screen cage and a rotor of the pressure screen, said rotor being arranged for rotation inside the screen cage, the lower portion of the casing forming a vortex cleaner, the bottom portion of the vortex cleaner being provided with a heavy material outlet and the upper portion of said vortex cleaner being provided with an accepted stock outlet which is arranged to communicate with the inside of the screen cage, said unit further comprising an inlet for the suspension to be classified, the inlet being arranged in proximity to the lower end of the rotor, said unit further comprising an outlet for the separated fraction of the suspension, said outlet being arranged above the screen cage.

An apparatus of this type is known from DT-AS (West German patent application published for inspection) No. 1,461,090. It comprises a connection pipe which is arranged to extend downwardly into the vortex cleaner and is fixedly secured to a mounting flange disposed between the upper and the lower portion of the casing, the connection pipe thus forming an outlet for accepted stock of the vortex cleaner. In proximity to this connection pipe, i.e. somewhat beneath the screen cage and the rotor of the pressure screen, communicates an inlet connecting pipe for feeding the suspension to be classified into the vortex cleaner, the latter connecting pipe being disposed substantially tangentially and being slightly inclined to slope downwardly so that the incoming suspension to be classified in the vortex cleaner generates flow conditions having the form of a downwardly directed helix. This flow causes the separation of heavy particles contained in the incoming suspension. The separated heavy particles can be removed through an outlet for heavy particles which is arranged at the bottom of the vortex cleaner. The suspension flows from the above vortex cleaner region through the central portion of the vortex cleaner upwardly and through the said connection pipe, to enter the inside of the pressure screen. In the known device, the rotor consists of a plurality of stirring foils which are fixedly secured to a central shaft and which are inclined with respect to the axis of the rotor in such a way as to force the suspension to flow upwardly. The particles of the suspension which cannot pass through the perforations of the screen cage are removed through an outlet disposed above the screen cage, which outlet is tangentially arranged with respect to the casing and is provided with closure means of the type of a slide valve.

The known devices of the above type are mainly applied in classifying of unsorted mixture of paper stock. It has been found that the known devices can be improved in various respects. When operating with stock which has a comparatively high density of the suspension, i.e. with high consistency suspensions, the vortex cleaner does not operate in satisfactory manner as the circulation velocity of the suspension is too low despite the tangential arrangement of the inlet connection pipe communicating with the vortex cleaner. This has as a consequence an accumulation of solid particles of the classified suspension on the stirring foils of the rotor which, in turn, results in that the pressure screen has to be stopped and cleaned, often after a very short period of operation.

Thus, it is an object of the present invention to improve the known devices of this type in such a way as to make it possible to classify, in an uninterrupted operation, fibrous suspensions which have a comparatively high density, and in particular, fiber suspensions containing unsorted mixed waste paper stock. Outgoing from a device of the above mentioned prior art, the device according to the present invention achieves the above object by an improvement which is characterized in that a rotor is used having the form of a cylindrical shell which is closed at least at its bottom portion and about its circumference. The rotor is provided at its circumference with at least one stirring element or stirring rod, acting upon the screen cage. The bottom portion of the rotor comprises means for circulating the suspension to be classified. An enclosed rotor having stirring elements rotating comparatively close to the screen cage, is — surprisingly — the only possible type of rotor making it possible to avoid the accumulation or conglomeration of solid particles from the suspension on the rotor, without the disadvantage — which a man skilled in the art would normally fear — of clogging of the space between the rotor and the screen cage, after a short operation of the device. In particular, if the rotor were provided with a rotary screen, which is known per se, then it would be impossible to avoid the set of arms by which the rotating screen cage would have to be connected to the rotor shaft; the solid particles of the suspension would accumulate and agglomerate on the arms in the same way as they do on the stirring foils of the known devices of this type. The clearance between the stirring element or stirring elements of the rotor of the present invention and the stationary screen cage is selected so as to secure that the stirring elements have the desired pulsation effect on the openings of the screen cage, i.e. that they create reciprocal flow in the openings of the screen cage generated by reciprocal pressure waves, thus preventing the cloggin of the screen openings. On the other hand, the clearance between the stirring elements and the screen cage cannot be so small as to smear up the openings with solid particles contained in the screened suspension. At the same time, the enclosed rotor generates the desired forced stock circulation with the device arranged on its bottom, i.e. a comparatively fast whirling motion of the suspension in the vortex cleaner with flow conditions having the form of a downwardly directed helix so that the particles having a high specific weight are separated in the vortex cleaner of the device according to the present invention in much more complete way than in the above described device of known prior art. Moreover, it has been found that the required stock circulation can be obtained at a comparatively small consumption of power of the rotor drive, particularly when operating with fibrous suspensions of a comparatively high density, wherein an outstanding circulation of the stock cannot be obtained at all by merely arranging a tangential inlet of the incoming high density flow.

The danger of accumulation of solid particles on the stirring elements is minimized when the same have the form of flat rods which are fixedly secured to the cylindric casing and which extend substantially in the direction of the axis of the cylinder, the rods being preferably wedge-shaped in cross section. This type of stirring elements makes it possible to obtain the known effect whereby the suspension is forced to flow upwardly, providing that the rods are slightly inclined with respect to the axis of the cylinder.

The maximum size of the particles of the suspension to be classified depends on the pulper which is normally disposed before the device according to the present invention. In other words, it depends on the size of the openings in the outlet screen of the pulper. In a preferable embodiment of the device according to the present invention, the spacing between the cylindric case of the rotor which forms the circumference of the rotor, and the screen cage, is somewhat greater than the maximum size of the particles of the suspension to be classified. The spacing is preferably 20 to 25 mm. The clearance between the stirring elements and the screen cage can be smaller than the maximum size of the particles, as sufficient intermediate space is provided at the circumference of the rotor between the individual stirring elements. In a preferable embodiment of the device according to the present invention, the clearance between the stirring elements and the screen cage is 10 to 15 mm.

A device for generating stock circulation can be obtained at minimum cost by using the bottom of the rotor, which may be provided with at least one, preferably several, and in particular with three ribs which extend in radial direction. By the rotary motion of the rotor, these ribs generate acceleration of the suspension flow in radial and tangential direction, thus supporting the desired whirling of the stock. Due to the slight inclination of the stock inlet with respect to the cross-sectional plane of the device, it is of advantage to make the surface of the bottom of the rotor of conical shape.

In a preferable embodiment of the device according to the present invention, care has been taken of the problem of securing that a solid material accumulation in the comparatively narrow space between the rotor and the screen cage is automatically removed thus securing the automatic operation of the device according to the invention. Outgoing from the basic thought that if there is a stock accumulation in this space, the power consumption of the drive means of the rotor must increase, the present invention includes a proposal that the outlet valve for the separated rejects be controlled in dependence on the power consumption of the drive device in such a way that the outlet valve is temporarily opened in an automatic manner upon exceeding a predetermined value of power consumption. In order to implement these thoughts, it is inessential whether the outlet valve is temporarily fully closed and opened upon exceeding the predetermined power consumption figure, or whether the valve is permanently maintained in slightly opened position and is further opened upon exceeding the predetermined magnitude of the power consumption.

The drive means is usually formed by an electric motor and it is suitable in such a case to implement the foregoing proposal by including in the power circuit of the motor a current metering device as well as an actuating device for opening the outlet valve, which actuating device is controlled by the said electric current metering means.

The concept according to the present invention can be combined with control elements for the outlet valve, wherein the valve is periodically opened or further opened and then again brought into the original condition. For this purpose, a timing circuit is provided for in one preferred embodiment of the invention, for periodical opening and closing of the discharge valve.

Further features and details of the present invention will become apparent from the following description with reference to the accompanying drawings of a preferable embodiment of the apparatus according to the present invention.

Figure 1:
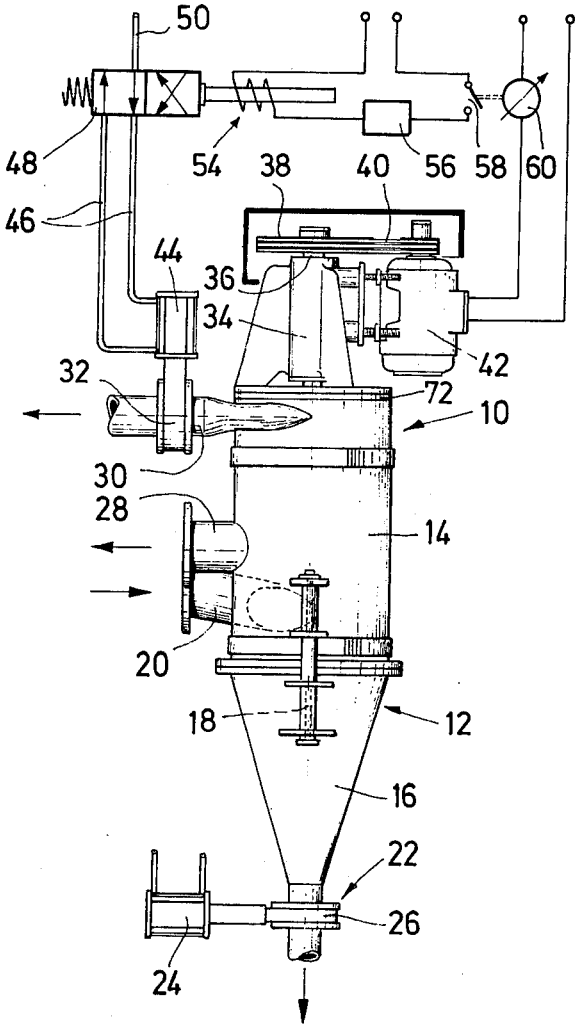
FIG. 1 is a side view of the apparatus.
Figure 2:
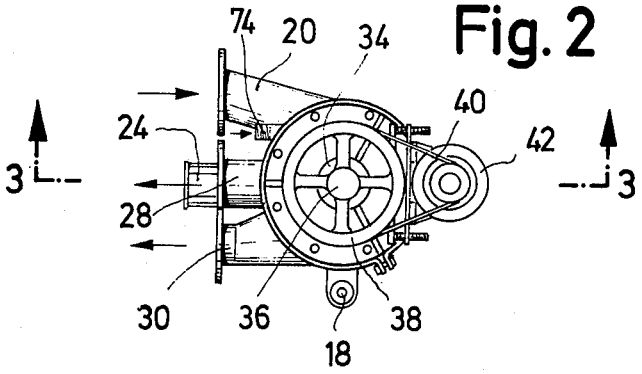
FIG. 2 is a plan view of the apparatus.

The apparatus shown in FIGS. 1 and 2 consists of a pressure screen and of a vortex cleaner which is disposed below the pressure screen, wherein the pressure screen portion is generally designated by reference number 10 and the vortex cleaner portion by reference numeral 12. The casing of the apparatus consists, in general, of an upper chamber portion 14 and a conical bottom portion 16, which is pivotable about an axis 18, in order to provide for access to the inside of the apparatus. Communicating with the upper chamber portion 14 is an inlet feed pipe 20 which is arranged tangentially and is slightly inclined downwardly. The inlet connection pipe 20 is used in supplying the device with the suspension to be classified. Arranged at the lower end of the conical bottom casing 16 is a heavy particle outlet which is generally referred to with reference numeral 22 and is provided with a slide valve 26, the operation of which is controlled by a pneumatic cylinder 24. The outlet 22 for heavy particles is used in removing the particles separated in the vortex separator 12 of the device. The embodiment shown in the drawings is to be considered as a simplified version of the device; the heavy particle outlet portion preferably contains two slide valves with a collecting chamber disposed therebetween. The upper chamber portion 14 is further provided with an outlet 28, through which the screened suspension can be removed. It is further provided with an outlet 30 for so-called rejects. The outlet 30 is also provided with a slide valve 32.

Mounted on the upper chamber portion 14 is a bearing support of a rotor shaft 36; fixedly secured to the latter is a pulley 38 which is used in driving a rotor of the pressure screen 10, the pulley itself being driven by an electric motor 42 and a V-belt drive 40. The electric motor 42 is mounted on the bearing housing 34. FIG. 1 also shows, in diagrammatic way, the operation and control of the slide valve 32 of the rejected stock outlet. A reciprocally operated pneumatic cylinder is used in actuating the slide valve 32; it is provided with two inlets 46 for pressurized air and is arranged to communicate with a four-way valve 48 which, in turn, is connected to a source of pressure air through a conduit 50. The exhaust air openings of the four-way valve are not shown. The reference numeral 54 shows an actuating magnet 54 which is associated with the four-way valve. Thus, the unit 48, 54 is — in effect — a magnet operated valve. The electric circuit of the actuating magnet 54 includes a timing circuit 56 and a switch 58 which is controlled by a switching ammeter 60, the above two elements being arranged in the circuit in series; the switching ammeter is incorporated in the circuit of the electric motor 42. The operation of the control of the slide valve 42 of the outlet 30 for rejects will later be explained in association with the operation of the entire apparatus.

Figure 3:
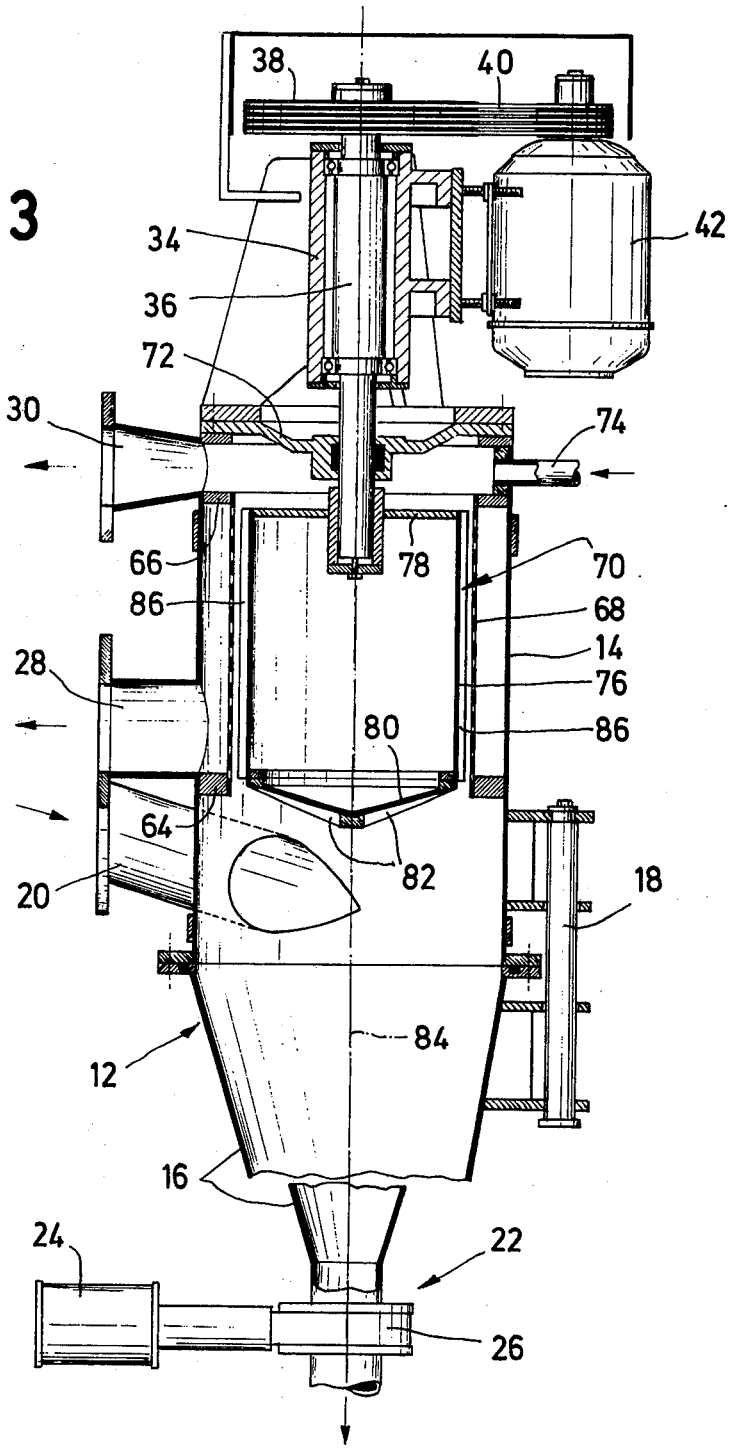
FIG. 3 is axial section of the apparatus along the lines 3 — 3 of FIG. 2.

It will be seen from FIG. 3 that welded in the upper chamber portion 14 are rings 64 and 66. The ring 64 of these is disposed between the inlet pipe 20 and the accepted stock outlet 28, and a further ring 66 is arranged beneath the rejected stock outlet. The rings support a stationary screen cage 68 in which is disposed a rotor which is generally referred to with reference numeral 70, the rotor being arranged coaxially with the screen cage. The rotor is mounted on the lower end of the rotor shaft 36 which is pivotally mounted in the bearing stand 34. The upper chamber portion 14 is enclosed by a cover 72 which is located above the outlet 30 for rejects, the cover 42 supporting the bearing housing 34. It is also to be noted that according to the invention, the upper chamber portion 14 is provided with a dilution water inlet 74 communicating into the chamber at the same level as the rejected stock outlet. The inlet for diluting water is also provided with a valve, the valve not being shown in the accompanying drawings.

Figure 4:
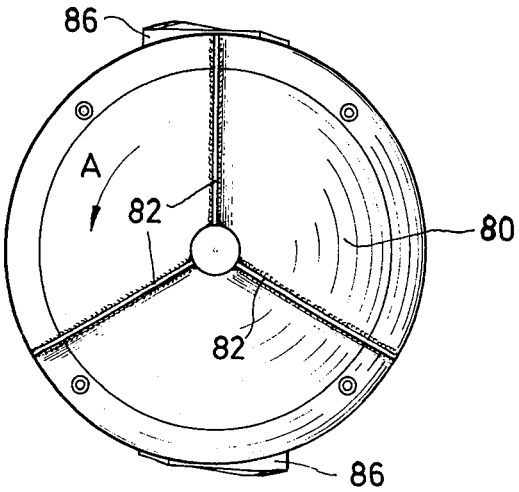
FIG. 4 is a bottom view of the rotor.

The rotor 70 comprises a cylindric casing 76 which is supported by a disc 78 which, in turn, is fixedly secured to the rotor shaft 36, the bottom portion of the casing 76 being closed by a conical bottom 80. As shown in FIGS. 3 and 4, three stock accelerating rods 82 are fixedly secured to the bottom. The inclination of the rods or ribs with respect to the axis of the overall apparatus corresponds to that of the inlet pipe 20.

Figure 5:
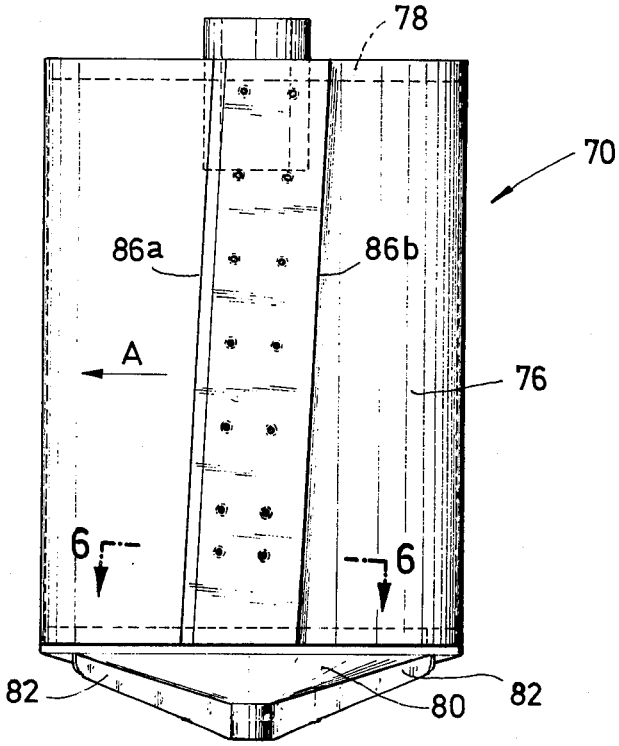
FIG. 5 is a side view of the rotor.
Figure 6:
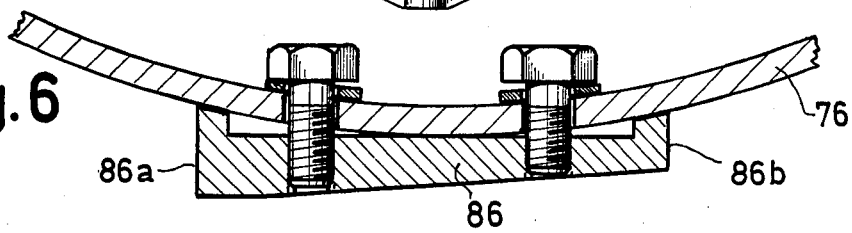
FIG. 6 is a section of one of the stirring rods of the rotor, taken along the line 6 — 6 of FIG. 5.

According to FIGS. 3, 5 and 6, two stirring rods or ribs 86 are fixedly secured to the casing 76, the stirring rods being disposed — with respect to the axis 84 of the apparatus — under an angle of inclination in such a manner as to create an upwardly directed lifting effect of the stirring rods upon the classified stock, when the rotor 70 is rotated in the direction of the arrow A of FIG. 5. The stirring rods have a generally wedge-shaped cross section, as will be seen from FIG. 6, of the type wherein the leading edge 86*a* is higher than the trailing edge 86*b*, whereby a particularly effective back-flush effect of the stirring rods is generated in the area of openings of the screen cage 68.

In the shown embodiment of the apparatus according to the present invention, the spacing between the casing 76 of the rotor 70 and the screen cage 68 is approximately 20 to 25 mm wide, while the clearance between the stirring rods 86 and the screen cage is approximately 10 to 15 mm.

The stock accelerating ribs 82 force the incoming suspension to be classified, which has been supplied through the inlet pipe 20 into the apparatus, towards the circumference; the suspension firstly flows downwardly on a helical path inside the vortex cleaner portion 12, wherein the particles having a high specific weight settle and can be removed through the heavy particle outlet 22 out of the chamber. The suspension is further caused to flow into the center of the vortex cleaner upwardly, to enter through the slot between the rotor 70 and the screen cage 68. The majority of water of the suspension passes, together with accepted fibers, through the screen case 68 and continues to flow to the accepted stock outlet 28, while the separated rejected particles of the suspension are forced to flow upwardly and to reach the level of the rejected stock outlet 30, partly due to the small specific weight of the rejected fraction, partly as a consequence of the raising effect of the stirring rods 86.

The switch 58 of the control of the slide valve 32 of the outlet 30 for rejects has to be closed when the power consumption of the electric motor is below the predetermined limiting value. If the timing circuit 56 of the circuitry of the actuating magnet 54 is not interrupted, the slide valve 32 has to stay entirely closed or, at most, slightly opened. The timing circuit 56 is necessary in order to provide periodical opening and closing of the circuit of the actuating magnet 54. Thus, the actuating magnet reverses the four-way valve 48 and the reciprocating pneumatic cylinder 44 opens the slide valve 32 still further or entirely, so that the separated particles of the suspension can be periodically removed through the outlet 30 in batches. If there is a danger of clogging of the space between the screen cage 68 and the rotor 70, the electric motor 42 has to overcome the increased load in the rotor region. When this load exceeds an appropriately predetermined limiting value, the switching ammeter 60 opens the switch 58 thus also causing the slide valve 32 to open and to remain opened until the strong flow thus created in the space between the screen cage 68 and the rotor 70 removes the clogging. The switching ammeter 60 then closes the switch 58 back and the slide valve 32 is thus closed. If necessary, the separated rejected particles of the fiber suspension, which are located above the rotor, can be diluted by dilution water coming from the inlet 74.

Thus, the arrangement according to the present invention secures an uninterrupted operation of the unit comprising the combination of a vortex cleaner and a pressure screen, by securing an outstanding circulation of the suspension in the vortex cleaner portion, by avoiding the accumulation of solid particles on the rotor and by the inventive control of the valve of the rejects outlet so as to avoid the clogging in the space between the screen cage and the rotor. Thus, the above arrangement makes it possible, for the first time, to provide a combination consisting of a vortex cleaner and a pressure screen which can be used in an uninterrupted continuous classification of waste paper stock suspensions having high density.

The invention having been described, what is claimed is:

1. A classifying unit for fibrous suspensions including in combination, a housing having an upper portion and a lower vortex cleaner forming portion, a stationary vertically disposed screen cage mounted in said upper housing portion, a generally cylindrical rotor closed over its circumferential portion and over its bottom, means mounting said rotor for rotary movement within said screen cage, a stirring element carried by the outer surface of said cylindrical portion of said rotor for cooperation with said screen cage for clearing the openings of said screen cage and the space between said screen cage and said rotor, means providing a heavy material outlet at the bottom of said vortex cleaner portion, means providing said upper housing portion with an accepted stock outlet communicating with the outer side of said screen cage, means providing said housing with an inlet adjacent to the bottom of said rotor for the admission of a suspension to be classified, means providing said housing with an outlet located above said screen cage for the removal of the separated fraction of the suspension, and means mounted on said rotor adjacent to said inlet for circulating the suspension to be classified within said vortex cleaner portion.

2. Apparatus according to claim 1, in which said circulating means are provided on the bottom of the rotor.

3. Apparatus according to claim 1, in which the stirring element is a rib which is fixedly secured to the circumferential cylindric portion of said rotor and which extends approximately in the direction of the axis of said cylindric portion.

4. Apparatus according to claim 3, in which said rib is slightly inclined with respect to the axis of the circumferential portion so as to ensure that rotation of the rotor forces the suspension of flow upwards.

5. Apparatus according to claim 1, in which the distance between the cylindric casing forming the circumferential portion of the rotor and the screen cage is slightly greater than the maximum size of the particles which are to be separated from said suspension.

6. Apparatus according to claim 5 in which said distance is between about 20 mm and about 25 mm.

7. Apparatus according to claim 1, in which the clearance between the stirring element and the screen cage is between about 10 mm and about 15 mm.

8. Apparatus according to claim 1, in which said circulating means comprises a rib extending generally in radial direction from the axis of rotation of the rotor and secured on the bottom of the rotor.

9. Apparatus according to claim 1 in which said circulating means comprises three ribs carried by the bottom of said rotor, said ribs extending generally in a radial direction from the axis of rotation of the rotor.

10. Apparatus according to claim 1, characterized in that the bottom of the rotor is conical in shape.

11. Apparatus according to claim 1 including a valve at the outlet for separated fractions of the suspension drive means for the rotor, and means responsive to the power consumed by said drive means for controlling said valve temporarily to open the same when said power consumed exceeds a predetermined drive power consumption.

12. Apparatus according to claim 11 in which said drive means comprises an electric motor and a power circuit for energizing said motor and in which said power consumption responsive means comprises a current metering device connected in said power circuit, an actuating device for opening said outlet valve, and means responsive to said metering device for operating said actuating device.

13. Apparatus according to claim 12 in which said metering device is a switching ammeter and in which said actuating device comprises a fluid pressure operated cylinder for actuating said outlet valve and a solenoid-operated valve for controlling said fluid pressure cylinder, said solenoid operated valve being operated by said switching ammeter.

14. Apparatus according to claim 13 including a timing circuit for periodically opening and closing said outlet valve.

15. Apparatus according to claim 14 in which said timing circuit is connected in series with said solenoid-operated valve.

* * * * *